US007559846B2

(12) United States Patent
Ferrell

(10) Patent No.: US 7,559,846 B2
(45) Date of Patent: Jul. 14, 2009

(54) MACHINING METHOD AND APPARATUS FOR THREAD FORMATION ON WORKPIECE

(75) Inventor: Adam Ferrell, Milford, CT (US)

(73) Assignee: Sandvik Medical Solutions Oregon, Inc., Oregon City, OR (US)

( * ) Notice: Subject to any disclaimer, the term of this patent is extended or adjusted under 35 U.S.C. 154(b) by 68 days.

(21) Appl. No.: 11/786,084

(22) Filed: Apr. 10, 2007

(65) Prior Publication Data

US 2008/0194348 A1 Aug. 14, 2008

Related U.S. Application Data

(63) Continuation-in-part of application No. 11/585,532, filed on Oct. 24, 2006.

(60) Provisional application No. 60/731,383, filed on Oct. 28, 2005.

(51) Int. Cl.
*B21H 3/02* (2006.01)

(52) U.S. Cl. ..... 470/66; 470/10; 470/70; 409/69; 409/73

(58) Field of Classification Search ..... 470/8, 470/9, 10, 12, 58, 66, 70, 72; 407/43, 51; 411/412, 413; 606/315, 316; 409/69, 73, 409/74

See application file for complete search history.

(56) References Cited

U.S. PATENT DOCUMENTS

| | | | | |
|---|---|---|---|---|
| 1,470,683 | A | 10/1923 | Boehm | |
| 1,827,615 | A | 10/1931 | Rosenberg | |
| 2,847,686 | A | 8/1958 | Jackson | |
| 3,209,652 | A * | 10/1965 | Burgsmueller | 409/66 |
| 3,680,971 | A | 8/1972 | Andrews | |
| 4,027,573 | A | 6/1977 | Laverty | |
| 4,258,607 | A | 3/1981 | McKewan | |
| 4,844,676 | A | 7/1989 | Adamek | |
| 4,917,555 | A | 4/1990 | Taubert | |
| 5,238,337 | A | 8/1993 | Nussbaumer et al. | |
| 5,259,398 | A | 11/1993 | Vrespa | |
| 5,569,009 | A * | 10/1996 | Suzuki | 411/413 |
| 5,735,653 | A * | 4/1998 | Schiefer et al. | 411/82 |
| 5,743,914 | A * | 4/1998 | Skiba | 606/304 |

(Continued)

FOREIGN PATENT DOCUMENTS

DE 3721732 1/1989

(Continued)

OTHER PUBLICATIONS

Tornos DECO 20a 0018 & 0020 Maintenance and Use.

(Continued)

*Primary Examiner*—Edward Tolan
(74) *Attorney, Agent, or Firm*—McCarter & English, LLP

(57) ABSTRACT

Machining techniques and machining apparatus are provided for treating workpieces in an efficient and reliable manner. The machining techniques and machining apparatus employ multiple thread whirling heads associated with a single machining assembly, such that each of the thread whirling heads is able to act on a workpiece during a single, uninterrupted machining process. Screw threads may be formed that include first and second thread profiles and an intermediate transition region. The machining apparatus generally includes a processor that is programmed to control operation of the multiple thread whirling heads in a sequential manner.

17 Claims, 5 Drawing Sheets

U.S. PATENT DOCUMENTS

| | | | | |
|---|---|---|---|---|
| 5,759,003 | A | 6/1998 | Greenway et al. | |
| 5,863,167 | A | 1/1999 | Kaneko | |
| 6,030,162 | A | 2/2000 | Huebner | |
| 6,045,312 | A | 4/2000 | Hsing | |
| 6,049,965 | A * | 4/2000 | Perkins, Jr. | 29/558 |
| 6,086,303 | A | 7/2000 | Fluckiger | |
| 6,116,832 | A | 9/2000 | Wolf et al. | |
| 6,129,730 | A | 10/2000 | Bono et al. | |
| 6,332,741 | B1 | 12/2001 | Janusz | |
| 6,503,252 | B2 | 1/2003 | Hansson | |
| 6,685,411 | B2 | 2/2004 | Kato | |
| 7,063,702 | B2 * | 6/2006 | Michelson | 606/307 |
| 2002/0192050 | A1 | 12/2002 | LeVey et al. | |
| 2003/0026675 | A1 | 2/2003 | McGovern et al. | |
| 2003/0185649 | A1 | 10/2003 | Mizuno et al. | |
| 2004/0081519 | A1 | 4/2004 | Gainer | |
| 2007/0233122 | A1 | 10/2007 | Denis et al. | |

FOREIGN PATENT DOCUMENTS

| | | |
|---|---|---|
| WO | WO2007/095447 | 8/2007 |

OTHER PUBLICATIONS

Internet Article: Medical Machining: Speed And Accuracy Win Orders, Production Machining, Jul. 14, 2005, url:<http://www.producctionmachining.com/articles/medical-maching-speed-and-accuracy-win-orders.aspx>.

PCT International Search Report dated Aug. 28, 2008.

* cited by examiner

MACHINING METHOD AND APPARATUS FOR THREAD FORMATION ON WORKPIECE

CROSS-REFERENCE TO RELATED APPLICATION

The present application is a continuation-in-part application that claims the benefit of a co-pending, non-provisional patent application entitled "Single Lead to Double Lead Screw Transition," which was filed on Oct. 24, 2006 and assigned Ser. No. 11/585,532. The present application also claims the benefit of a provisional patent application entitled "Screw Design and Associated Manufacturing Method," which was filed on Oct. 28, 2005 and assigned Ser. No. 60/731,383, priority to which was claimed in the foregoing non-provisional patent application. The entire contents of the foregoing non-provisional application and provisional patent application are incorporated herein by reference.

BACKGROUND

1. Technical Field

The present disclosure is directed to advantageous machining techniques and associated machining apparatus. The present disclosure is also directed to advantageous screw thread designs that may be efficiently and reliably fabricated using the disclosed machining techniques and/or machining apparatus. More particularly, the present disclosure is directed to machining techniques and associated machining apparatus that include multiple thread whirling heads, e.g., two thread whirling heads, associated with a single machining assembly, such that each of the thread whirling heads is able to act on a workpiece during a single, uninterrupted machining process.

2. Background Art

Screws and bolts find wide-ranging applications for attaching and/or securing elements, e.g., securing a first member with respect to a second member. Based on the diverse applications of such products, many designs have been developed. With particular focus on screw products, attention has been focused on screw thread designs and methods for fabrication thereof.

One particular area of interest for screw design and fabrication technologies is the orthopedic field. Given the clinical requirements of orthopedic screws, product performance and reliability are of tantamount importance. Titanium bone screws are used for spinal corrective surgery, trauma, and other types of bone repair and correction. Other bone screws are made of 316 stainless steel. Manufacture of bone screws generally involves strict requirements as to tolerances, surface properties, cleanliness and packaging. Titanium screws may generally range in length from 6 mm to 80 mm and have outer diameters (ODs) from 2 mm to 8.5 mm, although screws of greater length, e.g., 150 mm, shorter length, e.g., 2 mm, greater diameter, e.g., 16 mm, and lesser diameter, e.g., 1 mm, are also known. Typical bone screws require a 0.4-micron to 0.8-micron surface finish and dimensional tolerance of +/−0.025 mm. In certain applications, anodized coatings may be applied for color coding different sizes and types of screws.

In manufacture of a typical bone screw, the manufacturing operations include thread whirling, broaching, gundrilling and turning/milling. To achieve these manufacturing steps, it may be necessary to employ three or four separate machines. Two or more of the manufacturing operations may be combined using Computer Numerical Control (CNC) technology, i.e., a programmable machine tool that uses computer control technologies. CNC tools permit machine tool movements to be controlled so as to efficiently and reproducibly produce manufactured parts/products. Indeed, the manufacture of orthopedic screws generally involves a series of repetitive motions and CNC technology reduces those specific motions to computer code that guides/controls tool operations. Exemplary CNC machining tools are available under the DECO tradename from Tornos SA (Moutier, Switzerland). For purposes of Tornos machines, CNC control technology is referred to as "parallel numerical control" (PNC).

The ten-axis DECO machines can use two turning tools at the same time, completing rough and finish cuts in the same operation. One of the machine's cross slides accepts up to four live tools for operations, such as cross milling and off-center drilling. A gundrilling and high-pressure coolant attachment can be mounted on the end-working unit. Polygon milling of flats or contours can be accomplished using the machine's optional C axis on the main spindle. While the bar in the main spindle is machined, operations may be performed on the previously parted piece mounted on the counter spindle. A workpiece mounted in the pickoff spindle of a DECO machine may be typically worked by three (3) cross drilling or turning tools and by as many as six (6) end working tools.

Despite efforts to date, a need remains for improved orthopedic screw designs, manufacturing equipment and methods for fabrication of orthopedic screws. In particular, a need remains for improved bone screw designs and fabrication methods therefor. These and other needs are satisfied by the present disclosure.

SUMMARY

According to the present disclosure, advantageous machining techniques and associated machining apparatus are provided. The disclosed machining techniques and machining apparatus permit reliable and efficient fabrication of advantageous screw thread designs. According to exemplary embodiments of the present disclosure, machining techniques and machining apparatus are provided that include multiple thread whirling heads mounted with respect to a single machining assembly/apparatus. So assembled, the disclosed machining apparatus permits each of the thread whirling heads to act on a workpiece during a single, uninterrupted machining process. As used herein, the disclosed "single, uninterrupted machining process" refers to the totality of individual machining operations undertaken and performed by individual tooling elements mounted within or with respect to a machining apparatus.

The present disclosure is further directed to advantageous screw thread designs that may be efficiently and reliably manufactured using the disclosed fabrication techniques and machining apparatus. In exemplary embodiments, screw threads that include an intermediate transition, such that a single lead thread transitions to a double lead thread, may be efficiently and effectively fabricated in a single, uninterrupted process. In alternative embodiments, various screw thread transitions and/or combinations of screw thread transitions may be achieved and/or formed through programming and control of tool elements associated with the disclosed machining apparatus. For example, the disclosed methods and machining apparatus may be advantageously employed to achieve screw thread transitions (i) from a first single lead form to a second single lead form, (ii) from a first double lead form to a second double lead form, (iii) from a single lead form to a triple lead form, and combinations and/or variations thereof. The disclosed machining method and machining apparatus are thus not limited to fabrication of a specific screw thread transition, but have wide applicability in effecting many desirable thread transition designs and geometries.

The disclosed single lead to double lead thread transition may be advantageously fabricated with the disclosed machining method/technique and machining apparatus, and such screw thread transition offers several distinct advantages, including specifically (i) a substantially uniform/symmetric geometry in the transition region(s), and (ii) potentially enhanced engagement with a substrate/structure based on the design/geometry of the transition region(s). By creating the disclosed single lead to double lead thread transition in a single, uninterrupted machining operation, enhanced screw quality and integrity is achieved.

With reference to exemplary implementations of the disclosed machining technique and machining apparatus, advantageous screw thread transitions may be efficiently and reliably manufactured using such machining technique and machining apparatus by positioning metal stock (e.g., titanium) within a CNC machine, e.g., a DECO machine from Tornos SA modified for purposes of the present disclosure. As modified, the DECO machine operates as a 12 axis machine based on an added C-axis on each spindle. Indeed, a workpiece mounted in the pickoff spindle of the disclosed modified DECO machine may be typically worked by three (3) cross drilling or turning tools and by as many as six (6) end working tools. Further increases in tooling operations are contemplated according to the present disclosure.

The advantageous thread transitions of the present disclosure are achieved in an automated fashion using a single machine in a single, uninterrupted machining process. Thus, according to exemplary embodiments, the transition region and associated thread regions defined on either side of the transition region are sequentially formed using at least two (2) thread whirling heads in a single, uninterrupted machining process. Generally, each thread whirling head supports a plurality of substantially identical cutters, e.g., three (3) cutters spaced by about 120° around the circumference of the whirling head support body.

The first whirling head associated with the disclosed machining apparatus and associated machining technique includes first cutter(s) that are configured and dimensioned to generate a first thread profile. According to exemplary embodiments of the present disclosure, the "first thread profile" generated by the first whirling head is a wider thread profile as compared to a "second thread profile" (as described below), i.e., there is a greater distance from crest-to-crest (greater pitch) in the first thread profile as compared to the second thread profile. Thus, in an exemplary embodiment of the present disclosure wherein a single lead thread transitions to a double lead thread, the first whirling head and associated cutters are shifted along a length of the part/workpiece to remove material from the workpiece so as to define the single lead section with the wider first thread profile. The length of the first thread profile (as measured along the axis of the workpiece) may be varied to meet clinical requirements and/or other performance criteria. Thus, the first whirling head/first cutter(s) are generally programmed for limited travel along the length of the part/workpiece, such that—beyond forming an initial aspect of a to-be-defined transition region—the first cutter(s) typically do not contact the part/workpiece therebeyond.

After the first whirling head has formed the first thread profile, but with the workpiece still positioned within the machining apparatus, the second whirling head is automatically activated by the disclosed machining apparatus so as to engage/contact the workpiece to define a second thread profile and the remaining aspects of a transitional region between the first and second thread profiles. More particularly, the second cutter(s) associated with the second whirling head are brought into contact with the workpiece so as to define the thinner second thread profile and the remainder of the transitional region. Initially, the second cutter(s) travel within the thread region formed by the first whirling head until the unthreaded portion of the workpiece is reached. Thereafter, the second cutter(s) are effective to remove material from the workpiece so as to define a double thread region and a complete transition between the first and second thread profiles.

In an exemplary embodiment of the present disclosure, the transition region is defined as the threaded region between a first thread profile formed by the first whirling head/first cutter(s), i.e., the single/wider thread profile, and a second thread profile formed by the second whirling head/second cutter(s), i.e., the double thread region. The transition region is advantageously formed on the part/workpiece primarily with the second whirling head/second cutter(s), as described herein above. The second whirling head typically starts in the middle of the wider thread adjacent the remainder of the to-be-formed transition region and sweeps once to the right and once to the left, varying the helix angle to form the beginning of the thread for the narrower thread profile. The thread transition feeds directly into this narrower thread profile that is formed by the second whirling head/second cutter(s). Stated differently, the second whirling head/second cutter(s) is/are effective to form (i) a thread transition region that defines a transitional thread that feeds into an extended thread profile, and (ii) the extended thread profile to which the transitional thread is joined.

In use, the disclosed first and second thread whirling heads are mounted with respect to a single machining apparatus such that both thread whirling heads are adapted to sequentially engage and machine a part/workpiece in a single, uninterrupted machining process. Thus, the part/workpiece is typically fed to a machining position and positively secured in a desired machining position by a fixture. Significant reliability and accuracy in thread formation is achieved by facilitating multiple whirling head operations while the part/workpiece is positively secured and retained in the fixture, i.e., relative alignment of the first and second cutters relative to the part/workpiece may be achieved within strict tolerances.

Additional machining operations are typically undertaken to form a desirable finished product, e.g., an orthopedic bone screw. After the first and second thread whirling operations are complete, additional machining operations may be undertaken, as are known in the art, e.g., turning, milling, drilling and deburring operations. Additional processing may be performed within the machining apparatus. Additional operations may also be performed once the workpiece is removed from the machining apparatus, e.g., additional deburring operations. However, according to the present disclosure, a thread profile is formed in the machining apparatus that includes at least a first thread profile, at least a second profile, and a transition region therebetween.

According to exemplary embodiments of the present disclosure, the first and second thread whirling heads may be mounted with respect to a commercially available CNC machining unit that has been modified, as and if necessary, to accommodate operation of at least two (2) whirling heads relative to a part/workpiece that is fixtured relative thereto. First and second thread whirling heads may be positioned in a side-by-side orientation within a CNC unit. Programming associated with the CNC unit is generally provided to control operation of the first and second whirling heads so as to achieve a desired thread profile, e.g., a single/double lead thread profile with an intermediate transition therebetween.

Additional advantageous features and functions of the disclosed manufacturing technique, manufacturing apparatus and products manufactured thereby will be apparent from the description which follows.

BRIEF DESCRIPTION OF THE FIGURES

To assist those of ordinary skill in the art in making and using the disclosed screw and screw thread design, reference is made to the appended figures, wherein.

DESCRIPTION OF EXEMPLARY EMBODIMENT(S)

Figure 1:
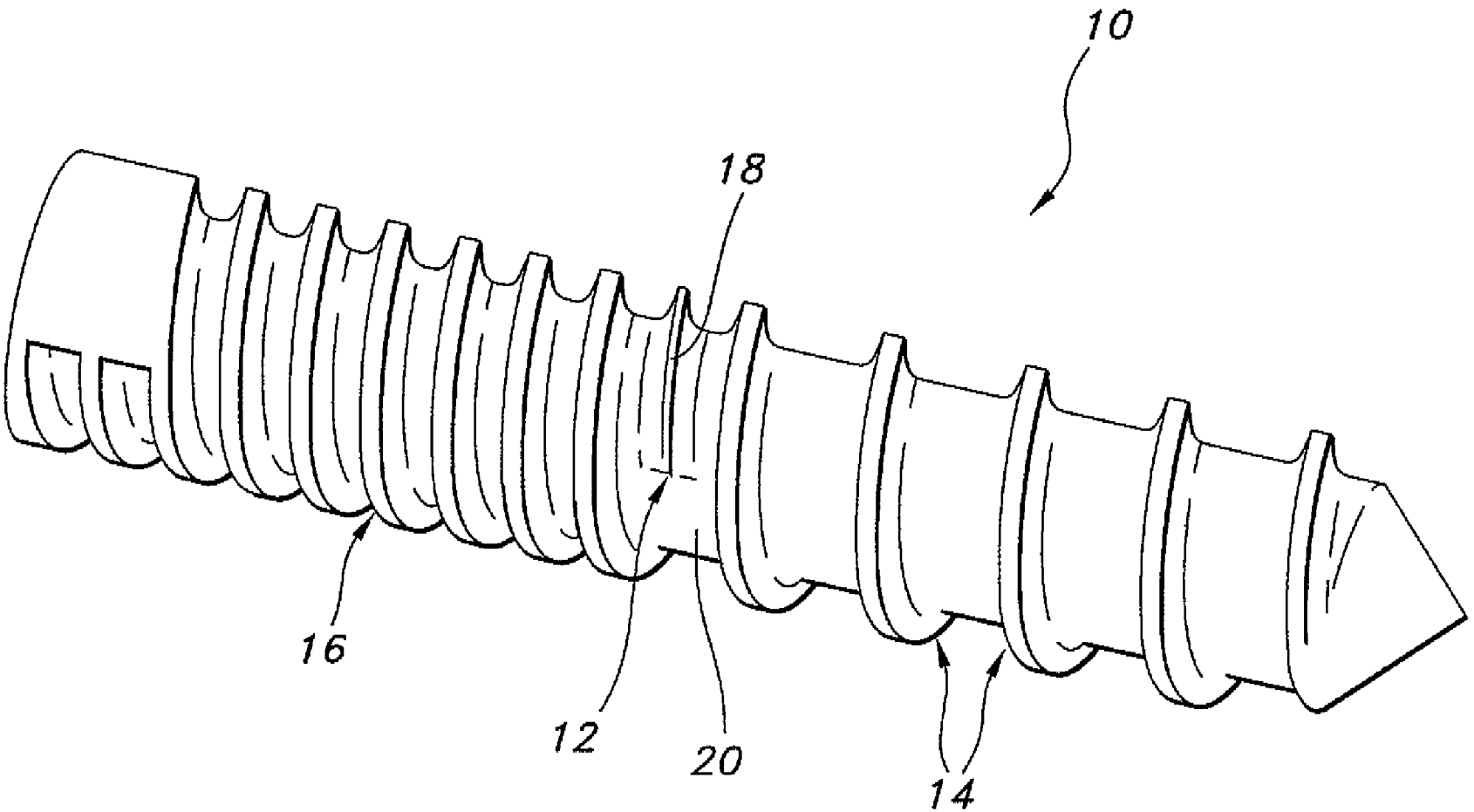
FIG. 1 is a plan view of an exemplary screw that includes an intermediate thread transition according to the present disclosure.
Figure 2:
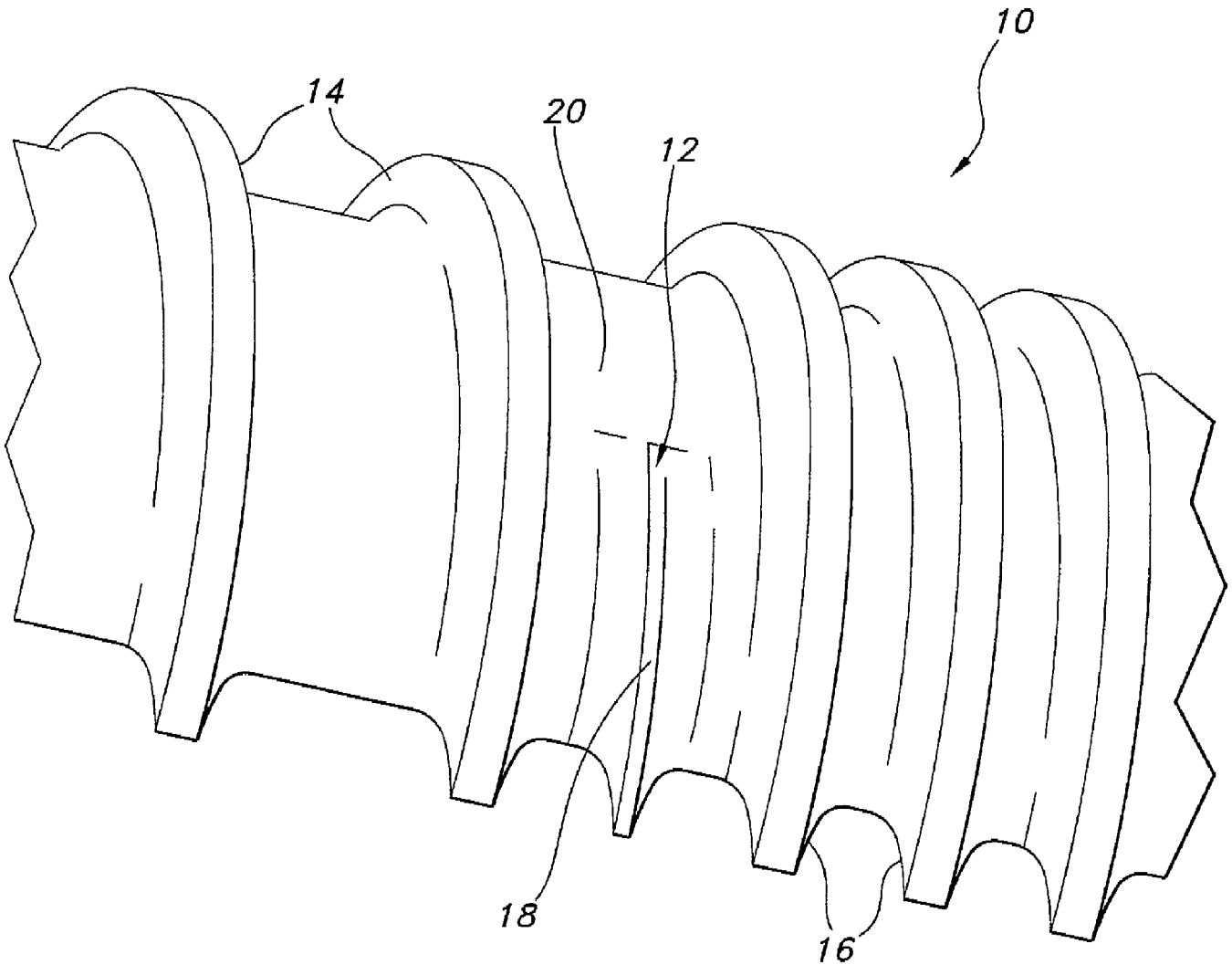
FIG. 2 is a plan view of a portion of the screw depicted in FIG. 1 that includes the exemplary intermediate thread transition of the present disclosure.

Advantageous machining techniques and associated machining apparatus are disclosed herein, such machining techniques and machining apparatus facilitating reliable and efficient fabrication of advantageous screw thread designs. The present disclosure also provides advantageous screw thread designs having particular applicability in orthopedic applications, e.g., bone screws, that include at least one intermediate transition between first and second thread profiles. The multiple screw thread profiles are formed in a single, uninterrupted machining process according to the present disclosure. Thus, in an exemplary embodiment of the present disclosure, the screw includes a first axial portion that defines a single lead thread profile and a second axial portion that includes a double lead thread profile. An intermediate transition is provided between the first axial portion and the second axial portion, i.e., between the single lead and double lead thread profiles. Exemplary screw thread profiles that may be achieved according to the present disclosure are schematically depicted in FIGS. 1 and 2, and are described in greater detail below.

Alternative advantageous thread profiles may be fabricated using the disclosed machining techniques and machining apparatus, as will be readily apparent from the detailed description which follows. For example, the machining techniques and machining apparatus disclosed herein may be used to form screw thread transitions: (i) from a first single lead form to a second single lead form; (ii) from a first double lead form to a second double lead form; (iii) from a single lead form to a triple lead form, and combinations and/or variations thereof.

Figure 3:
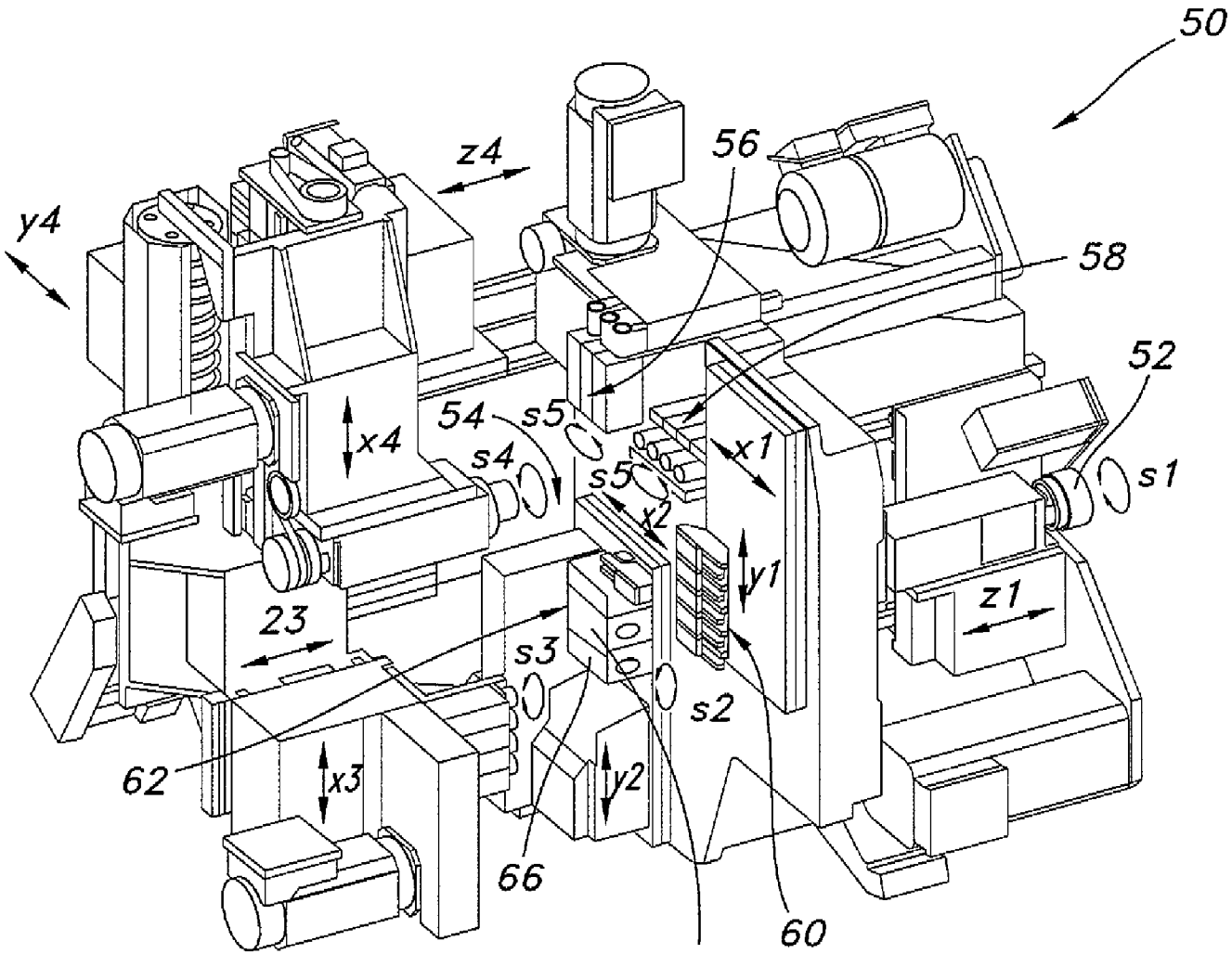
FIG. 3 is a plan view of a machining apparatus that includes a pair of side-by-side thread whirling heads according to the present disclosure.

With initial reference to FIG. 3, an exemplary machining apparatus 50 according to the present disclosure is schematically depicted. Machining apparatus 50 is a 10 axis-DECO 0010 machine with pickoff spindle and frontwork unit, which is available from Tornos SA. A workpiece (not pictured) is fed through spindle 52 in a work region 54 that is accessible to various tools that are mounted with respect to machining apparatus 50. Tool sets 56, 58, 60, 62 are among the tools that are operable in work region 54. For purposes of the present disclosure, tool set 62 is of particular significance because first and second thread whirling heads 64, 66 are mounted in side-by-side relation as part thereof. Thus, as disclosed herein the advantageous machining techniques and machining apparatus of the present disclosure generally include multiple thread whirling heads mounted with respect to a single machining assembly/apparatus, e.g., a 10 axis DECO machine from Tornos SA. Additional details concerning the design and operation of a DECO machine, including the 10 axis DECO apparatus 50 that is schematically depicted in FIG. 3, are available from Tornos SA, e.g., in the DECO operating manual, the contents of which are incorporated herein by reference.

Figure 4A:
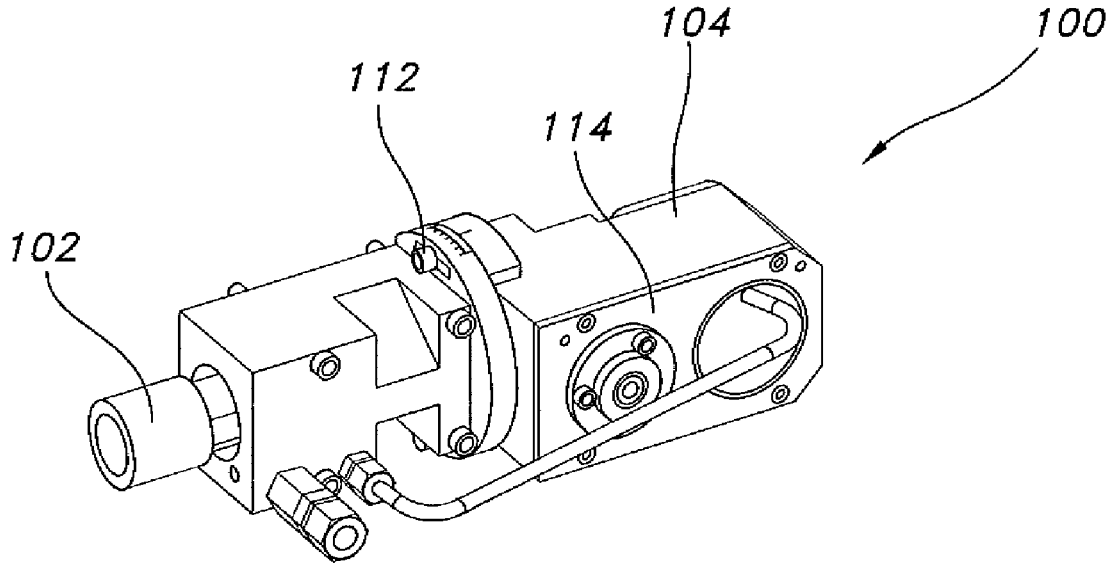
FIGS. 4A and 4B are perspective views of an exemplary thread whirling attachment for use with a machining apparatus of the present disclosure.
Figure 4B:
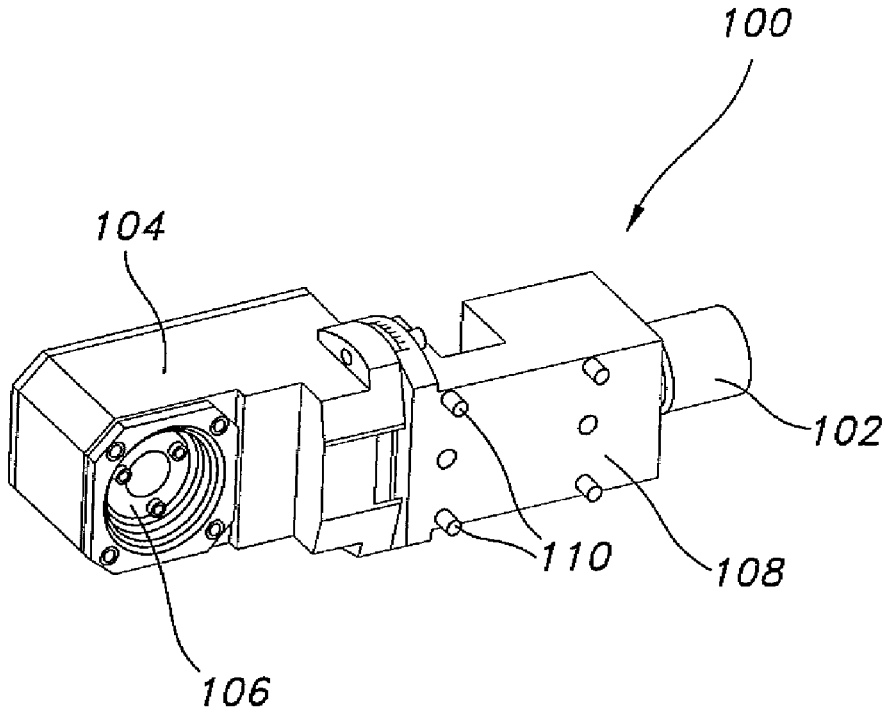

An exemplary thread whirling head 100 for use in a machining apparatus, e.g., machining apparatus 50 of FIG. 3, is schematically depicted in FIGS. 4A and 4B. The whirling head 100 depicted in FIGS. 3A and 3B is commercially available from Tornos (see, e.g., Drawing No. 3061010). Whirling head 100 includes a drive coupling 102 that is adapted to mount with respect to and interact with a machining apparatus (not pictured), e.g., a DECO machine. The drive coupling 102 communicates with gearbox 104 which delivers drive force to cutters that are mounted with respect to cutter chamber 106. Whirling head 100 also includes a base plate 108 that facilitates mounting of whirling head 100 with respect to the machining apparatus. A plurality of studs 110 extend outwardly from base plate 108 to facilitate such mounting. A gearbox screw 112 is provided for gearbox adjustments and a cover plate 114 encases the gearbox components.

According to the present disclosure, at least two thread whirling heads, e.g., thread whirling heads of the general type depicted in FIGS. 4A and 4B, are mounted within a machining apparatus, e.g., a DECO machine 50 as depicted in FIG. 3. The machining apparatus 50 generally includes a processor that is programmed so as to energize the thread whirling heads to contact a workpiece in a sequential manner. Generally, each thread whirling head supports a plurality of substantially identical cutters, e.g., three (3) cutters spaced by about 120° around the circumference of the whirling head support body.

Figure 5:
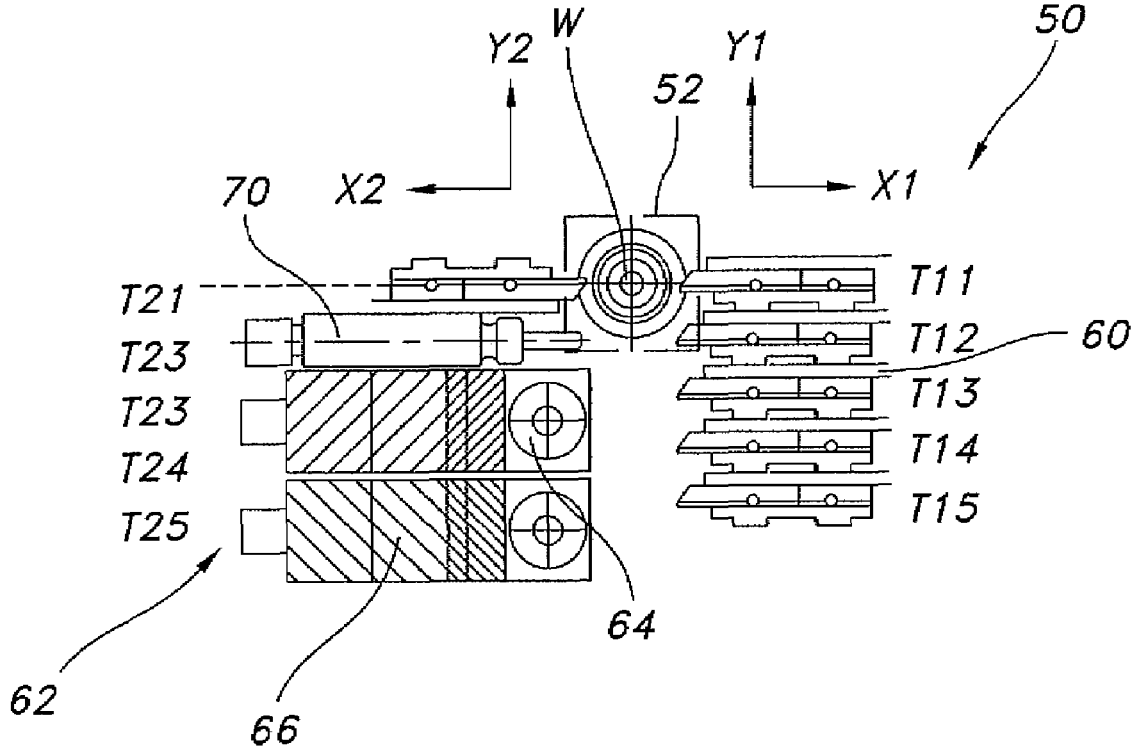
FIG. 5 is a side view of exemplary machining tools mounted within a machining apparatus of the present disclosure.

In an exemplary embodiment of the present disclosure, two thread whirling heads are mounted in a side-by-side orientation within a DECO machine 50, e.g., at positions designated T22, T23, T24, T25 and the region below T25, as such terms are used by Tornos in connection with DECO tool positioning. This arrangement is schematically depicted in FIG. 5, where a workpiece "W" extends from spindle 52. First and second thread whirling heads 64, 66 are positioned in side-by-side relation and are mounted with respect to machining apparatus 50. Whirling heads 64, 66 are adapted for axial movement along axes X2 and Y2, as shown in FIG. 5. An additional tool set 60 is also mounted with respect to machining apparatus 50, as shown in FIG. 5. The tools included in tool set 60 are adapted for axial movement along axes X1 and Y1. Axial movement of tool sets 60, 62 relative to workpiece "W" is controlled by a control unit (not pictured) associated with apparatus 50, and permits whirling heads 64, 66 to be brought into engagement with workpiece "W" in a sequential manner to form desired thread profiles. Of note, the whirling heads 64, 66 depicted in FIG. 5 are of a smaller profile, such that whirling heads 64, 66 fit within positions T23, T24, T25 and below, thereby freeing up position T22 for an additional tool 70.

As modified, the DECO machine 50 operates as a 12 axis machine based on an added C-axis on each spindle. Indeed, a workpiece mounted in the pickoff spindle of the disclosed modified DECO machine may be typically worked by three (3) cross drilling or turning tools and by as many as six (6) end working tools.

Exemplary thread whirling heads for use in the disclosed machining apparatus are advantageously adapted to operate at a maximum speed of 5000 rpm and to deliver a maximum torque of about 16 Nm. Each whirling head is generally adapted to deliver a drive ratio of 1:1 and accommodate angular adjustability of +/−15 degrees. The foregoing operating parameters may be varied and/or modified, as will be apparent to persons skilled in the art. For example, greater angular adjustability, e.g., +/−25 degrees, may be accommodated without departing from the spirit or scope of the present disclosure. Alternative thread whirling head designs and/or alternative CNC units may also be employed according to the present disclosure without departing from the spirit or scope of the present disclosure, as will be readily apparent to persons skilled in the art. However, fundamental to the present disclosure is the inclusion of at least two thread whirling heads in a single machining apparatus so as to sequentially act on a workpiece during a single, uninterrupted machining process.

The multi-whirling head assemblies of the present disclosure are effective to form advantageous thread transitions in an efficient and reliable manner. The fabrication technique generally involves positioning metal stock (e.g., titanium) within a CNC machine, e.g., a DECO machine from Tornos SA modified for purposes of the present disclosure, and effecting the desired machining activities during a single, uninterrupted machining process. The thread transition is imparted to the metal stock in an automated fashion using a single machine in a single, uninterrupted machining process.

With reference to FIGS. 1 and 2, an exemplary screw 10 that may be fabricated with the disclosed machining apparatus and machining technique is schematically depicted. Screw 10 includes a transition region 12 between the wide single lead thread 14 and the narrow double lead thread 16. The transition region 12 is defined at an intermediate point along the axis of the screw, e.g., at or near a mid-point thereof. Within the transition region 12, a thread 18 is formed which functions to transition between the double lead thread region of thread 16 and the single lead thread region of thread 14. Thread 18 substantially bisects groove 20—which is of a width consistent with the wide single lead thread 14—and is surrounded by a substantially uniform/symmetric geometry on either side thereof. Moreover, thread 18 slopes up from groove 20 in a relatively smooth manner.

According to exemplary embodiments of the present disclosure, a first whirling head associated with the disclosed machining apparatus and associated machining technique includes first cutter(s) that are configured and dimensioned to generate a first thread profile, i.e., thread 14. The "first thread profile" generated by the first whirling head is a wider thread profile as compared to a "second thread profile," i.e., thread 16. Thus, there is a greater distance from crest-to-crest (greater pitch) in the first thread profile as compared to the second thread profile. Thus, the first whirling head and associated cutters are shifted along a length of the part/workpiece to remove material from the workpiece so as to define the single lead section with the wider first thread profile, i.e., thread 14. The length of the first thread profile (as measured along the axis of the workpiece) may be varied to meet expected clinical requirements. Thus, the first whirling head/first cutter(s) are generally programmed for limited travel along the length of the part/workpiece. While the first cutter (s) is/are generally effective to define an initial aspect of the transition region, the first cutter(s) typically do not contact the part/workpiece in therebeyond.

After the first whirling head has formed the first thread profile, i.e., thread 14, but with the workpiece still positioned within the machining apparatus, the second whirling head is automatically activated by the disclosed machining apparatus so as to engage the workpiece to define a second thread profile, i.e., thread 16, and the remaining aspects of a transitional region 12 between the first and second thread profiles. More particularly, the second cutter(s) associated with the second whirling head are brought into contact with the workpiece so as to define the thinner second thread profile 16 and the remainder of the transitional region 12. Initially, the second cutter(s) travel within the thread region formed by the first whirling head, i.e., thread 14, until the unthreaded portion of the workpiece is reached. Thereafter, the second cutter (s) are effective to remove material from the workpiece so as to define a double thread region 16 and a complete transition 12 between the first and second thread profiles.

The transition region 12 is primarily formed on the part/workpiece with the second whirling head/second cutter(s). The second whirling head typically starts in the middle of the wider thread 14 adjacent the remainder of the to-be-formed transition region 12 and sweeps once to the right and once to the left, varying the helix angle to form the beginning of the thread for the narrower thread profile 16. The thread transition 12 feeds directly into this narrower thread profile 16 that is formed by the second whirling head/second cutter(s). Stated differently, the second whirling head/second cutter(s) is/are effective to form (i) a thread transition region 12 that defines a transitional thread 18 that feeds into an extended thread profile 16, and (ii) the extended thread profile 16 to which the transitional thread 18 is joined.

Additional machining operations are typically undertaken to form a desirable finished product, e.g., an orthopedic bone screw. For example, a preliminary turning operation may be undertaken to define the major geometry of the part. Conventional single point threading may then be employed to form the tip of the part. After the first and second thread whirling operations are complete, additional machining operations may be undertaken, as are known in the art, e.g., turning, milling, drilling and deburring operations. Processing may also be performed within the machining apparatus, e.g., a modified DECO machine as described herein, using a sub-spindle positioned therewithin, e.g., turning, milling, drilling, broaching and/or micro-milling. Additional operations may be performed once the workpiece is removed from the machining apparatus, e.g., additional deburring operations. Notwithstanding the potential for additional processing steps, however, a thread profile is formed in the machining apparatus of the present disclosure as part of a single, uninterrupted machining process that includes at least a first thread profile, at least a second profile, and a transition region therebetween.

The disclosed screw thread transition may be advantageously fabricated with the disclosed machining method/technique and machining apparatus, and such screw thread transition offers several distinct advantages, including specifically (i) a substantially uniform/symmetric geometry in the transition region(s), and (ii) potentially enhanced engagement with a substrate/structure based on the design/geometry of the transition region(s). By creating the desired screw thread transition(s) in a single, uninterrupted machining operation, enhanced screw quality and integrity is achieved. The disclosed thread transition has wide ranging applications, including spinal and/or orthopedic screw applications.

Exemplary implementations of the disclosed thread transition include bone screws, pedicle screws and cervical screws.

Although the present disclosure includes descriptions of exemplary embodiments and implementations of the machining apparatus, machining techniques and advantageous screws and screw thread designs, the present disclosure is not limited to or by such exemplary embodiments. Rather, the subject matter of the present disclosure extends to a host of modifications, variations and enhancements that do not depart from the spirit or scope of the present disclosure.

The invention claimed is:

1. A machining apparatus, comprising:

(a) a spindle;

(b) a plurality of thread whirling heads independently rotatably mounted with respect to the machining apparatus, the thread whirling heads of the plurality thereof at least including respective first and second thread whirling heads; and (c) a processor programmed so as to energize the first and second thread whirling heads to contact, in a sequential manner, a workpiece extending from the spindle;

wherein the first and second thread whirling heads are mounted for operation by the processor in a single, uninterrupted machining process in which the first thread whirling head contacts the workpiece and forms thereon a first screw thread profile, and the second thread whirling head contacts the workpiece and forms thereon a second, different screw thread profile.

2. A machining apparatus according to claim 1, wherein the machining apparatus includes a machining chamber, and each of the first and second thread whirling heads is positioned within the machining chamber.

3. A machining apparatus according to claim 1, wherein the first and second thread whirling heads are mounted in side-by-side orientation.

4. A machining apparatus according to claim 1, wherein the processor implements computer numerical control (CNC) with respect to the first and second thread whirling heads.

5. A machining apparatus according to claim 1, further comprising at least one additional tool mounted with respect to the machining apparatus and selected from the group consisting of a turning tool, a milling tool, a drilling tool, and a deburring tool.

6. A machining apparatus according to claim 1, wherein each of the first thread whirling head and the second thread whirling head includes a corresponding plurality of cutting heads.

7. A method for machining a workpiece, comprising:

(a) providing a workpiece of metal stock;

(b) feeding the workpiece into a machining apparatus that includes: (i) a plurality of thread whirling heads independently rotatably mounted with respect to the machining apparatus, the thread whirling heads of the plurality thereof at least including respective first and second thread whirling heads, and (ii) a processor programmed so as to energize the first and second thread whirling heads to contact, in a sequential manner, the workpiece; and (c) employing the processor to machine the workpiece with each of the first and second thread whirling heads in a single, uninterrupted machining process in which the first thread whirling head contacts the workpiece to define thereon a first screw thread profile, and the second thread whirling head contacts the workpiece to define thereon a second, different screw thread profile.

8. A method according to claim 7, wherein the machining apparatus is a computer numerical control (CNC) unit.

9. A method according to claim 7, wherein the single, uninterrupted machining process further includes employing the processor to form a transition region disposed between the first screw thread profile and the second screw thread profile, the transition region defining a structurally smooth axial transition between the first and second screw thread profiles.

10. A method according to claim 9, wherein the transition region is formed at least partially by employing the processor to machine the workpiece with the first thread whirling head, and at least partially by employing the processor to machine the workpiece with the second thread whirling head.

11. A method according to claim 7, wherein the single, uninterrupted machining process further includes employing the processor to machine the workpiece to define a screw thread transition selected from the group consisting of: (i) a transition from a first single lead form to a second single lead form; (ii) a transition from a first double lead form to a second double lead form; (iii) a transition from a single lead form to a triple lead form, and combinations thereof.

12. A method according to claim 7, wherein the single, uninterrupted machining process further includes employing the processor to perform at least one additional processing step with respect to the workpiece.

13. A method according to claim 12, wherein the at least one additional processing step is selected from the group consisting of turning, milling, drilling and deburring.

14. A method according to claim 7, wherein the first and second thread whirling heads are mounted in a side-by-side orientation within the machining apparatus.

15. A method according to claim 9, wherein one of the first and second screw thread profiles at least includes a first groove defining a corresponding lower margin, the other one of the first and second screw thread profiles at least includes a first thread defining a corresponding upper margin, and the transition region includes an extension of the first thread that slopes up smoothly from a depth associated with the lower margin of the first groove to a height associated with the upper margin of the first thread.

16. An orthopedic screw fabricated according to the method of claim 15.

17. A method according to claim 7, wherein the single, uninterrupted machining process further includes employing the processor to machine the workpiece to form a third screw thread profile disposed between the first screw thread profile and the second screw thread profile, the third screw thread profile defining an axial transition between the first and second screw thread profiles.

* * * * *